US011607034B2

(12) United States Patent
Stiefelmaier et al.

(10) Patent No.: US 11,607,034 B2
(45) Date of Patent: Mar. 21, 2023

(54) SUPPORTING DEVICE FOR A HEIGHT ADJUSTABLE TABLE FRAME

(71) Applicant: Kesseböhmer Holding KG, Bad Essen (DE)

(72) Inventors: Philipp Stiefelmaier, Weilheim (DE); Michael Köder, Plochingen (DE)

(73) Assignee: Kesseböhmer Holding KG, Bad Essen (DE)

( * ) Notice: Subject to any disclaimer, the term of this patent is extended or adjusted under 35 U.S.C. 154(b) by 0 days.

(21) Appl. No.: 17/467,508

(22) Filed: Sep. 7, 2021

(65) Prior Publication Data

US 2022/0087410 A1 Mar. 24, 2022

(30) Foreign Application Priority Data

Sep. 23, 2020 (DE) ..... 10 2020 211 930.9

(51) Int. Cl.
*A47B 9/12* (2006.01)
*A47B 9/10* (2006.01)

(52) U.S. Cl.
CPC ..... *A47B 9/12* (2013.01); *A47B 9/10* (2013.01); *A47B 2200/005* (2013.01)

(58) Field of Classification Search
CPC ..... A47B 9/12; A47B 9/10; A47B 2200/005; A47B 2200/0051; A47B 2200/0054
See application file for complete search history.

(56) References Cited

U.S. PATENT DOCUMENTS

| | | | | |
|---|---|---|---|---|
| 9,700,136 | B1 * | 7/2017 | Zebarjad | A47B 9/02 |
| 2010/0187380 | A1 | 7/2010 | Koeder | |
| 2015/0047538 | A1 * | 2/2015 | Ergun | A47B 9/02 248/188.5 |

FOREIGN PATENT DOCUMENTS

| | | | | |
|---|---|---|---|---|
| CN | 111345581 | A * | 6/2020 | |
| DE | 19756725 | | 7/1999 | |
| DE | 102004046673 | | 3/2006 | |
| DE | 102007025215 | | 4/2009 | |
| DE | 102009007125 | | 8/2010 | |
| DE | 202019102312 | U1 * | 6/2019 | A47B 9/00 |
| DK | 2213198 | | 8/2010 | |
| DK | 1987734 | | 2/2011 | |
| EP | 1987734 | A1 * | 11/2008 | A47B 9/12 |

(Continued)

OTHER PUBLICATIONS

Translation of EP 1987734 A1 from espacenet (Year: 2022).*

*Primary Examiner* — Daniel J Rohrhoff

(57) ABSTRACT

A supporting device for a height adjustable table (1) comprises a first (3) and a second supporting element (3') respectively having a first, a second, and a third liner component (5, 5', 6, 6', 7, 7') arranged in a manner displaceable relative to each other to cause a change of length (L) of the supporting elements (3, 3'). The first (5, 5'), the second (6, 6') and the third liner component (7, 7') are coupled such that a displacement of the second to the first liner component synchronously causes a displacement of the third to the second liner component. The supporting device comprises a synchronization device to synchronize the displacement of the second liner component (6, 6') to the first liner component (5, 5') or the displacement of the third liner component (7, 7') to the second liner component (6, 6') between the first and the second supporting elements.

8 Claims, 4 Drawing Sheets

(56) References Cited

FOREIGN PATENT DOCUMENTS

| | | | | | |
|---|---|---|---|---|---|
| EP | 2213198 | | 8/2010 | | |
| EP | 2213198 | A1 * | 8/2010 | ..... | A47B 9/10 |
| EP | 1987734 | | 12/2010 | | |
| ES | 2808980 | T3 * | 3/2021 | ..... | A47B 9/12 |
| WO | WO 2018/145399 | | 12/2008 | | |

* cited by examiner

SUPPORTING DEVICE FOR A HEIGHT ADJUSTABLE TABLE FRAME

RELATED APPLICATION

This application claims the benefit of priority of German Patent Application No. 10 2020 211 930.9 filed on Sep. 23, 2020, the contents of which are incorporated herein by reference in their entirety.

FIELD AND BACKGROUND OF THE INVENTION

The invention relates to a supporting device for a height adjustable table, particularly for a height adjustable table having several supporting elements.

In the state-of-the-art, height adjustable tables which, in order to carry and lift loads put on a tabletop of the height adjustable table in a safe and reliable manner, comprise several height adjustable table legs, in the following, also denominated as supporting elements.

Thereby, there is the problem that components of the height adjustable table legs cant and, therefore, jam when the table legs do not move synchronously.

Further, there are two standards for desktops in which a minimally adjustable height of the working surface and a necessary stroke distinguish. The greater of the demands of the two standards cannot be fulfilled with two-part lifting columns, particularly with built in compression gas springs, since the required minimum adjustable height of the working surface is smaller than the necessary installation dimension for a gas spring having the required minimum stroke.

The invention is based on the object to remedy the above problems and to provide a supporting device for a height adjustable table enabling a reliable function of the height adjustable table across an entire adjustment range for an economic working height of the tabletop.

The object is achieved by a supporting device according to claim 1 and a height adjustable table according to claim 8. Advantageous further developments of the invention are included in the dependent claims.

SUMMARY OF THE INVENTION

According to an aspect of the invention, a supporting device for a height adjustable table comprises a first supporting element and at least one second supporting element, wherein the first supporting element and the at least one second supporting element respectively comprise a first liner component, a second liner component, and a third liner component. The first liner component, the second liner component, and the third liner component are arranged in a manner displaceable to each other in order to respectively cause a change of length of the first supporting element and the at least one second supporting element. In a direction of the change of length, the second liner component is arranged between the first liner component and the third liner component and the first liner component, the second liner component, and the third liner component are coupled to one another such that upon the change of length of the first supporting element and the at least one second supporting element, a displacement of the second liner component to the first liner component in a direction parallel to the change of length synchronously causes a displacement of the third liner component to the second liner component in the same direction. The supporting device further comprises a synchronization device configured to synchronize the displacement of the second liner component to the first liner component or the displacement of the third liner component to the second liner component between the first supporting element and the at least one second supporting element.

By the defined motion of the individual liner components with respect to each other, bending moments exerted to the supporting elements, which, for example, arise by propping up at the rim of a desktop during a height adjustment or by larger loads put on eccentrically on the desktop can be rescued without excessively burden the guiding devices or sliding blocks. That shall enable a sliding of the liner components into each other as backlash free as possible. This defined motion is executed in an accordingly synchronized manner so that canting of the several supporting elements cannot occur.

In an advantageous implementation of the supporting device, an amount of the displacement between the second liner component and the first liner component and an amount of the displacement between the third liner component and the second liner component are identical.

By the identical amounts of displacement between the second liner component and the first liner component and between the third liner component and the second liner component, the load onto the guiding devices or sliding blocks can be minimized.

In a further advantageous implementation of the supporting device, the supporting device comprises an endless ropelike element and two third diverter rollers being arranged in a spaced manner in the direction of the change of length of the first supporting element and the at least one second supporting element and being connected with the second liner component, wherein the endless ropelike element is configured to be redirected by the two third diverter rollers in a backlash free manner and a portion of the endless ropelike element is, in the direction of the change of length of the first supporting element and the at least one second supporting element between the two third diverter rollers, respectively connected with the first liner component and the third liner component.

By this arrangement, the identical amounts of displacement between the second liner component and the first liner component and between the third liner component and the second liner component can particularly easily be realized.

According to a further advantageous implementation of the supporting device, the ropelike element is a steel band.

By using the steel band having a high tensile strength, its dimensioning with a small diameter is possible which also enables a use of diverter rollers having smaller dimensions so that installation space can be saved. Except from that, due to the marginal elongation of the steel band, an exactly defined motion of the individual liner components with respect to each other is possible.

In a further advantageous implementation of the supporting device, the third diverter rollers comprise a convexity on the running surface along their rotational axes.

By the convexity, i.e., a bulge of the running surface towards the center of the running surface, a self-centering ensues upon running of the steel band so that a reliable operation without additional centering devices is possible.

In a further advantageous implementation of the supporting device, the synchronization device comprises a first ropelike synchronization element, at one end, fixed to one of the liner components of the first supporting element and, at the other end, fixed to the same of the liner components of the at least one second supporting element, and first diverter rollers respectively fixed to another one of the liner components of the first supporting element and of the at least one second supporting element, wherein the other one of the liner components of the first supporting element and of the at least one second supporting element is respectively the same liner component and a redirection of the first ropelike synchronization element take place by means of the first diverter rollers in a manner that a first relative displacement between two of the liner components of the first supporting element results in a synchronous relative displacement between the two same liner components of the at least one second supporting element.

By this arrangement, the relative displacement between two same liner components between the two supporting elements can easily be realized.

According to a further advantageous implementation of the supporting device, the synchronization device comprises a second ropelike synchronization element, at one end, fixed to one of the liner components of the first supporting element and, at the other end, fixed to the same of the liner components of the at least one second supporting element, and the two diverter rollers respectively fixed to the other one of the liner components of the first supporting element and of the at least one second supporting element, wherein the other one of the liner components of the first supporting element and of the at least one second supporting element are respectively the same liner component. A redirection of the second ropelike synchronization element by means of the second diverter rollers takes place in a manner that an opposite relative displacement between two of the liner components of the first supporting element opposite with respect to the first relative displacement in the first supporting element results in a synchronous opposite relative displacement between the two same liner components of the at least one second supporting element.

By this arrangement, the opposite relative displacement between two same liner components between the two supporting elements can also be realized easily.

In a further advantageous implementation of the supporting device, the first and second ropelike elements are respectively a steel band.

The use of the steel band allows a use of diverter rollers having a small diameter and, due to a small elongation of the steel band, an exactly defined synchronization of the relative motions between the first supporting element and the second supporting element with respect to each other is possible.

At a further advantageous implementation of the supporting device, the first diverter rollers and second diverter rollers respectively comprise a convexity on the running surface along their rotational axis.

Thereby, upon the running of the steel band, a self-centering takes place so that a reliable operation without additional centering devices is possible.

According to a further advantageous implementation of the supporting device, the supporting device comprises a drive or power assist element which drives or assists the change of length of the first supporting element and of the at least one second supporting element.

By the use of the drive or power assist element, the tabletop, particularly having a large load, can be adjusted without or with a low muscle force.

In a further advantageous implementation of the supporting device, the drive or power assist element is a compression gas spring.

The compression gas spring as the drive or power assist element has a small required space and can be provided cost-effective.

In a further advantageous implementation of the supporting device, the compression gas spring is arranged in at least one of the first and the at least one second supporting element.

By the coupling of the liner components, it is possible to install a compression gas spring into the supporting element since the stroke of the compression gas spring can be smaller than the maximum change of length of the supporting element. Thereby, the compression gas spring in its retracted state has a length which is smaller than the available installation space. Thus, a compact design and reduced total installation effort are possible since the supporting element with the gas spring can already be easily pre-assembled and, thus, an effort during the final assembly is reduced.

According to another advantageous implementation of the supporting device, the compression gas spring is provided between the first supporting element and the at least one second supporting element and it is configured to exert a drive or power assist force to the ropelike synchronization element.

According to this implementation, it is possible to provide the supporting elements having a smaller cross-section since the required space of the gas spring in the supporting element is omitted so that creative requirements can be implemented more easily.

In further advantageous implementations, the drive or power assist element is configured to exert a drive or power assist force between the first liner component and the second liner component or between the second liner component and the third liner component.

By such an application of the drive or power assist force, the drive or power assist element having a small displacement stroke and, therefore, having a necessary installation space with a smaller length can be implemented since, by coupling the first, second, and third liner components, a larger change of length of the supporting elements than the change of length of the drive or power assist element results.

According to a further aspect of the invention, a height adjustable table is provided with a supporting device.

With such a height adjustable table, it is made possible that bending moments exerted to the supporting elements, for example, by propping up at the rim of a desktop during a height adjustment or by larger loads put on eccentrically on the desktop can be rescued without excessively burden onto the guiding devices or sliding blocks. This enables a sliding of the liner components into each other as backlash free as possible. Further, the motion for height adjustment is executed in a synchronized manner so that canting of the several supporting elements cannot occur.

BRIEF DESCRIPTION OF THE SEVERAL VIEWS OF THE DRAWINGS

Subsequently, the invention is elucidated by means of embodiments referring to the attached drawings.

In particular.

DESCRIPTION OF SPECIFIC EMBODIMENTS OF THE INVENTION

Figure 1:
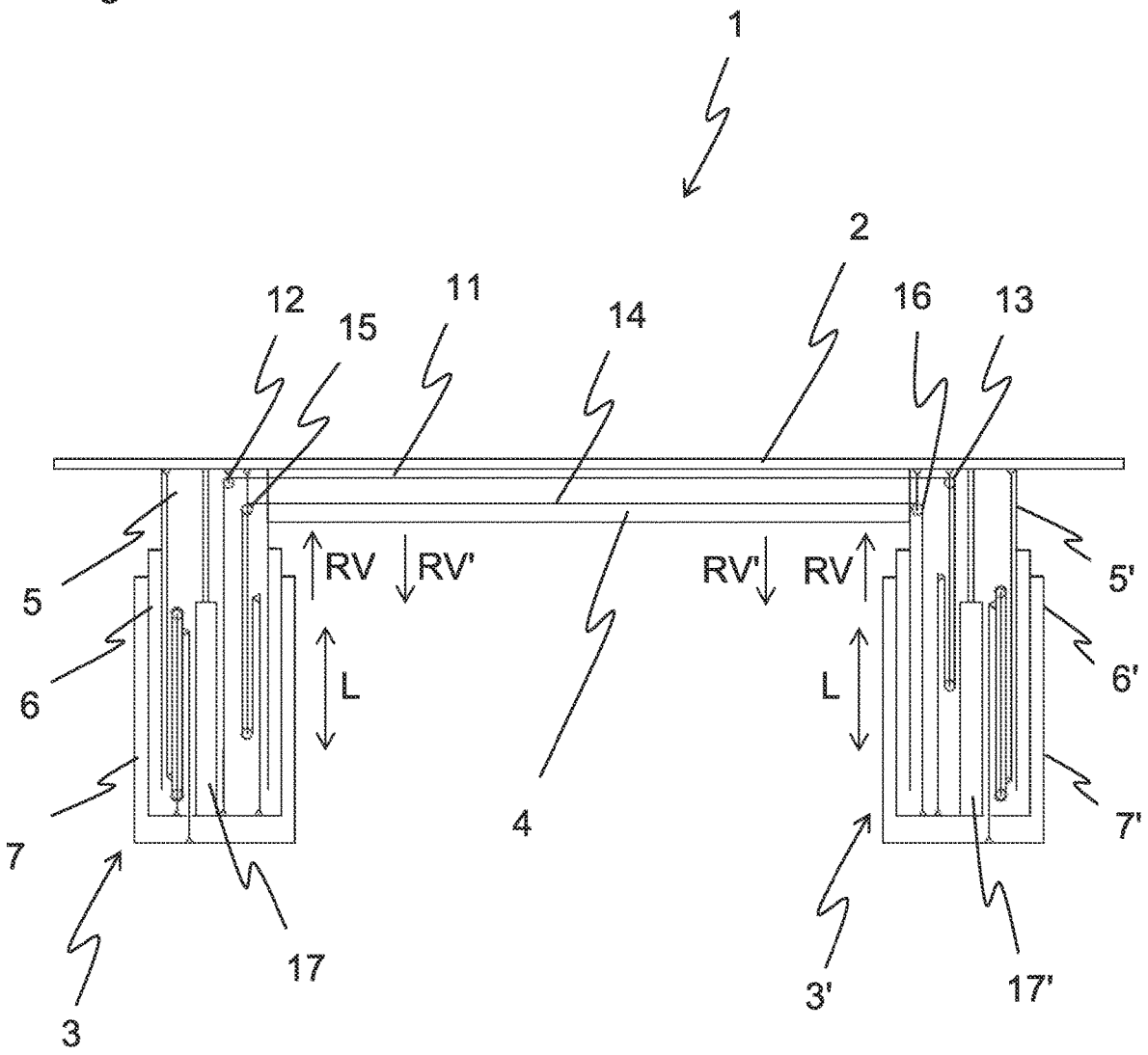
FIG. 1 shows a principal illustration of a height adjustable table according to the invention.
Figure 1A:
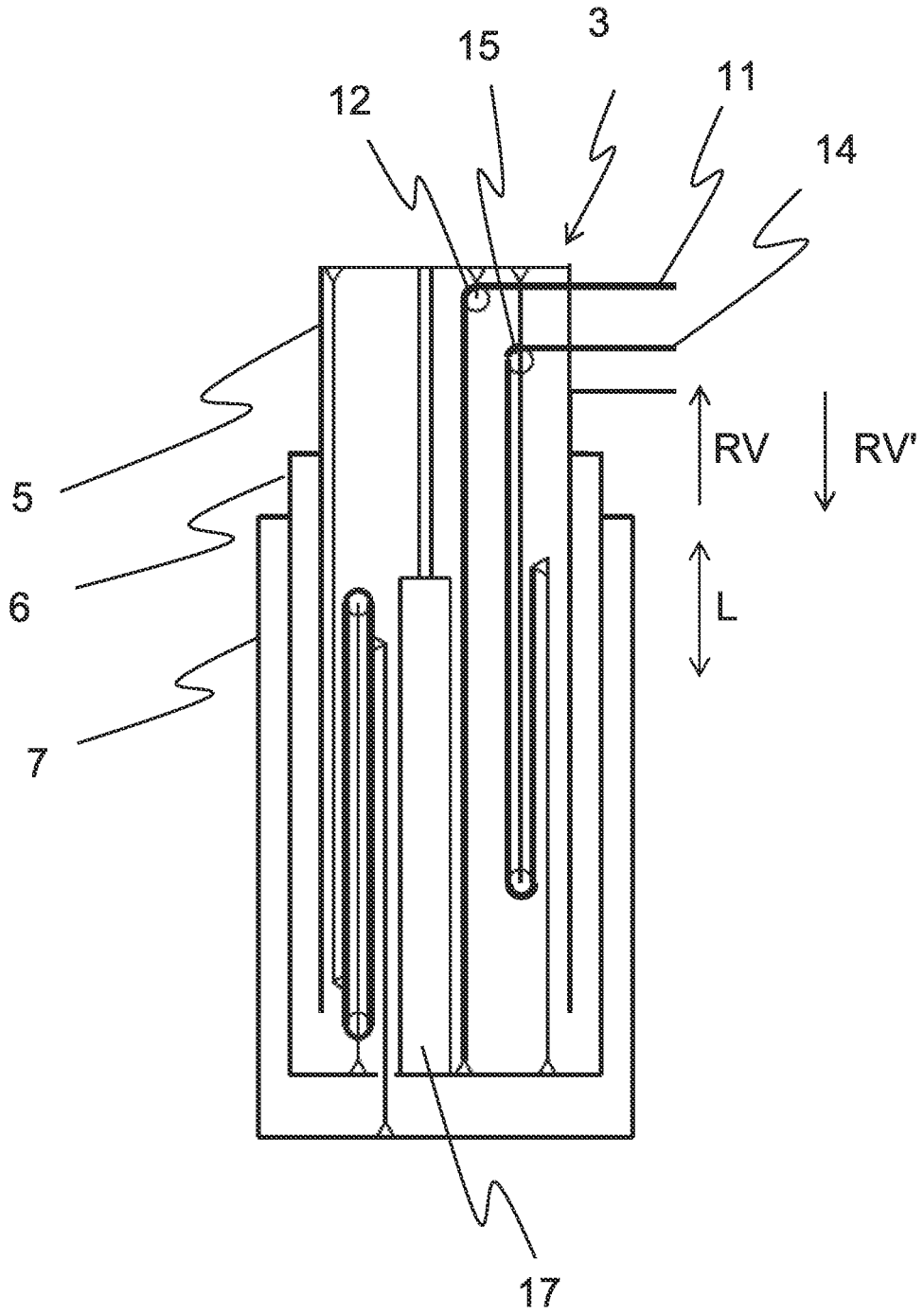
FIG. 1*a* shows an enlarged principal illustration of the supporting element 3.

FIG. 1 principal illustration of a height adjustable table 1 according to the invention.

The height adjustable table 1 comprises a tabletop 2 and a supporting device having a first supporting element 3 and a seconding supporting element 3'. Here, the supporting elements 3, 3' form table legs by which a change of length L is possible in order to adjust the height of the tabletop 2. The supporting elements 3, 3' are connected to each other by means of a crossbar 4 and they are fixed to the tabletop 2 at an appropriate distance. In an alternative embodiment, the supporting elements 3, 3 are individually fixed to the tabletop without comprising the crossbar 4. In further alternative embodiments, more than two supporting elements 3, 3' are provided.

The supporting elements 3, 3' respectively comprise a first liner component 5, 5', a second liner component 6, 6', and a third liner component 7, 7'. The first liner component 5, 5', the second liner component 6, 6', and the third liner component 7, 7' are arranged in a manner displaceable relative to each other in order to respectively cause the change of length L of the first supporting element 3 and of the second supporting element 3'. In direction of the change of length L, the second liner component 6, 6' is arranged between the first liner component 5, 5' and the third liner component 7, 7'. The first liner component 5, 5' is connected with the tabletop 2. The third liner components 7, 7' is connected with a table base (not shown) such that the height adjustable table 1 can stand on a floor without tilting.

The supporting device further comprises a drive or power assist element 17, 17' in each of the supporting elements 3, 3', wherein the drive or power assist element 17, 17' drives or assists the change of length L of the first supporting element 3 and of the second supporting element 3'. The power assist element 17, 17' assists, for example, a human muscle force during the height adjustment of the tabletop in order to reduce the power effort. The drive element, however, execute the height adjustment of the tabletop without human muscle force.

In this embodiment, the drive or power assist element 17, 17' is a compression gas spring. In alternative embodiments, for example, a hydraulic cylinder or an electromotive operated linear drive can be provided. In further alternative embodiments, one of the drive or power assist elements 17, 17' is not provided for each of the supporting elements 3, 3' but merely, for example, one single drive or power assist element 17, 17' for one of the supporting elements 3, 3' is provided.

The compression gas springs are arranged inside the supporting elements 3, 3'. In alternative embodiments, the compression gas springs are arranged outside the supporting elements 3, 3'.

The drive or power assist element 17, 17' is configured to exert a drive or power assist force between the first liner component 5, 5' and the second liner component 6, 6'. In an alternative embodiment, the drive or power assist element 17, 17' is configured to exert a drive or power assist force between the second liner component 6, 6' and the third liner component 7, 7'.

The supporting device further comprises a synchronization device configured to synchronize the displacement of the second liner component 6, 6' to the first liner component 5, 5' or the displacement of the third liner component 7, 7' to the second liner component 6, 6'.

The synchronization device comprises a first ropelike synchronization element 11, at one of its ends, fixed to one of the liner components of the first supporting element 3, in this embodiment, to the second liner component 6, and, at the other end, to the same of the liner components, here, also to the second liner component 6', of the second supporting elements 3'. Further, the synchronization device comprises two first diverter rollers 12, 13 respectively fixed to another one of the liner components, in this embodiment, to the first liner component 5, 5'. A redirection of the first ropelike synchronization element 11 takes place by means of the two first diverter rollers 12, 13 in a manner such that the relative displacement RV between two of the liner components, in this embodiment, between the second liner component 6 and the first liner component 5, of the first supporting element 3 causes a synchronous relative displacement RV between the two same liner components of the second supporting element 3', in this embodiment, between the second liner component 6' and the first liner component 5'.

In alternative embodiments, the first ropelike synchronization element 11 and the two first diverter rollers 12, 13 can also be attached to another liner component 5, 5', 6, 6', 7, 7' of the first supporting element 3 and the second supporting element 3', wherein it is essential that the two liner components 5, 5', 6, 6', 7, 7' respectively distinguish and that the liner component 5, 5', 6, 6', 7, 7 on the first supporting element 3 and on the second supporting elements 3' is respectively the same liner component 5, 5', 6, 6', 7, 7'.

The synchronization device further comprises a second ropelike synchronization element 14, at one end, fixed to one of the liner components of the first supporting element 3, in this embodiment, to the second liner component 6 and, at the other end, to the same of the liner component of the second supporting element 3', here, also to the second liner component 6'. Further, the synchronization device comprises two second diverter rollers 15, 16 respectively fixed to another one of the liner components, in this embodiment, to the first liner component 5, 5'. A redirection of the second ropelike synchronization element 14 takes place by means of the two second diverter rollers 15, 16 in a manner such that an opposite relative displacement RV between two of the liner components of the first supporting element 3, in this embodiment, between the third liner component 7 and the first liner component 5, results in an opposite relative displacement RV' between the two same liner components of the second supporting element 3', in this embodiment, between the second liner component 6' and the first liner component 5'.

In alternative embodiments, the second ropelike synchronization element 14 and the two second diverter rollers 15, 16, can also be attached to other liner components 5, 5', 6, 6', 7, 7' of the first supporting element 3 and of the second supporting element 3', wherein it is essential that the two liner components 5, 5', 6, 6', 7, 7 of one of the supporting elements 3, 3' respectively distinguish and the liner component 5, 5', 6, 6', 7, 7' of the first supporting element 3 and of the second supporting element 3' is respectively the same liner component 5, 5', 6, 6', 7, 7'.

The first ropelike synchronization element 11 and the second ropelike synchronization element 14 are respectively formed as a steel band. In alternative embodiments, the first ropelike synchronization element 11 and the second ropelike synchronization element 14 can also, for example, be implemented as a plastic band or as a steel rope.

Figure 2:
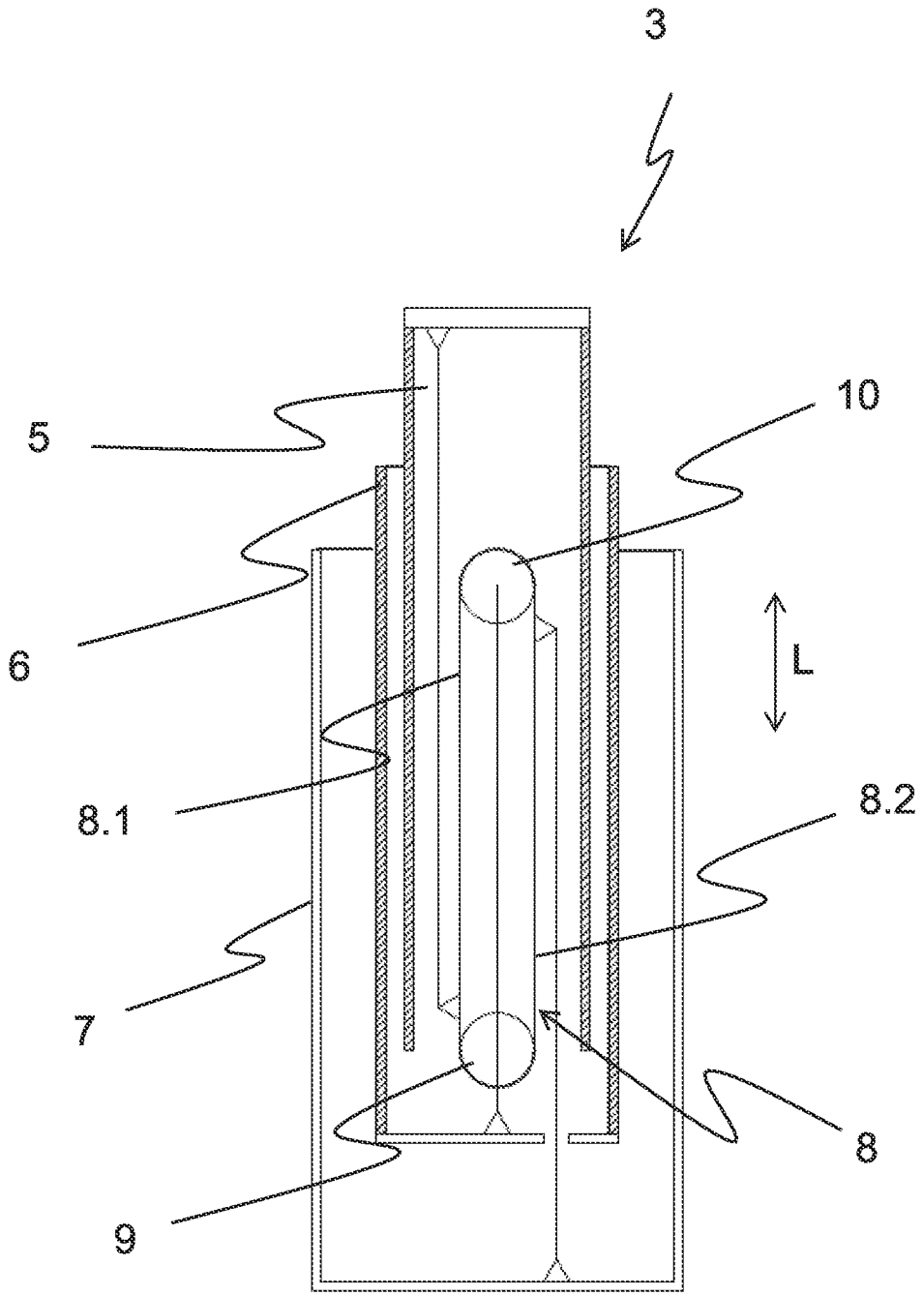
FIG. 2 shows a principal illustration of a supporting element having a coupling device of a first, second, and third liner component.

FIG. 2 shows a principal illustration of one of the supporting elements 3 having a coupling device of the first liner component 5, the second liner component 6, and the third liner component 7. The first liner component 5, the second liner component 6, and the third liner component 7 are coupled to one another such that, when changing the length L of the first supporting element 3, a displacement of the second liner component 6 to the first liner component 5 in a direction parallel to the change of length L causes a displacement of the third liner component 7 to the second liner component 6 in the same direction. The second supporting element 3' comprises an identical coupling device.

The supporting device 3 comprises an endless ropelike element 8 as the coupling device. Further, the supporting device 3 comprises two third diverter rollers 9, 10 being arranged in a spaced manner in the direction of the change of length L and being connected with the second liner component 6. The endless ropelike element 8 is configured to be redirected by the two third diverter rollers 9, 10 and a portion 8.1, 8.2 in the direction of the change of length L between the two third diverter rollers 9, 10 is respectively connected with the first liner component 5 and with the third liner component 7. Here, the portion 8.1 is connected with the first liner component 5 and the portion 8.2 is connected with the third liner component 7.

An amount of the displacement between the second liner component 6 and the first liner component 5 and an amount of the displacement between the third liner component 7 and the second liner component 6 are identical in this embodiment.

In alternative embodiments, when a coupling of different liner components 5, 5', 6, 6 ', 7, 7' takes place, for example, via threaded rods coupled to one another, the amount of the displacement between the second liner component 6, 6' and the first liner component 5, 5' and the amount of the displacement between the third liner component 7, 7' and the second liner component 6, 6' can be different.

The ropelike element 8 is implemented as a steel band. In alternative embodiments, the ropelike element 8 can also be, for example, implemented as a plastic band or a steel rope.

Figure 3:
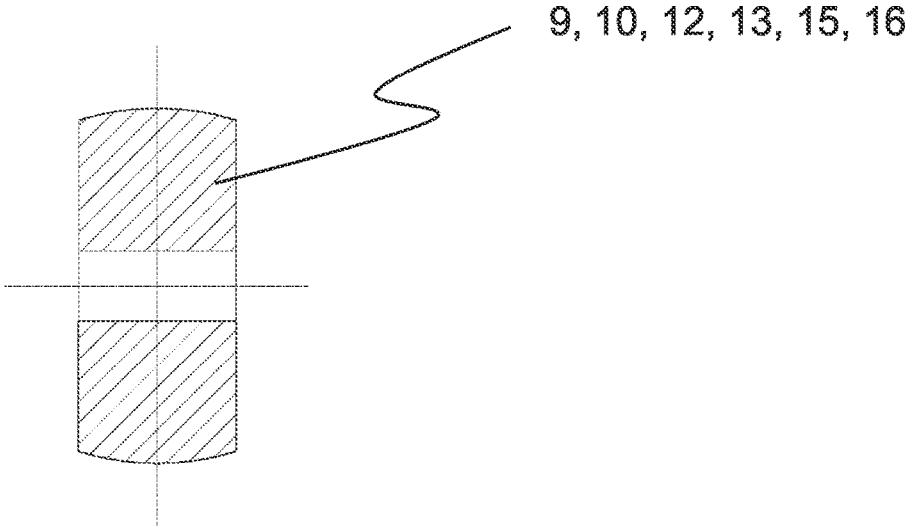
FIG. 3 shows a cross-sectional view of a diverter roller.

FIG. 3 so shows a cross-sectional view of one of the diverter rollers 9, 10, 12, 13, 15, 16.

The first, second, and third diverter rollers 9, 10, 12, 13, 15, 16 comprise a convexity on the running surface, namely a bulge of their running surface towards the center of the running surface, along their rotational axis. In alternative embodiments, at least some of the first, second, and third diverter rollers 9, 10, 12, 13, 15, 16 can also be provided with a straight running surface along their rotational axis.

In an alternative embodiment, the compression gas spring is provided between the first supporting element 3 and the second supporting elements 3' and it is configured to exert the drive or power assist force onto the first or second ropelike synchronization element 11, 14.

In a further alternative embodiment, the synchronization device is not provided with ropelike synchronization elements but the synchronization takes place, for example, via an axis having a both-sided bevel gear and respective threaded rods.

All features illustrated in the description, the subsequence claims, and the drawings can, solitarily or in an arbitrary combination, be relevant for the invention.

What is claimed is:

1. Supporting device for a height adjustable table (1), comprising:

a first supporting element (3) and at least one second supporting element (3'), wherein the first supporting element (3) and the at least one second supporting element (3') respectively comprise a first liner component (5, 5'), a second liner component (6, 6'), and a third liner component (7, 7'), wherein the first liner component (5, 5'), the second liner component (6, 6'), and the third liner component (7, 7') are arranged in a displaceable manner relative to each other in order to respectively cause a change of length (L) of the first supporting element (3) and of the at least one second supporting element (3'), the second liner component (6, 6') is arranged between the first liner component (5, 5') and the third liner component (7, 7') in a direction of the change of length (L), the first liner component (5, 5'), the second liner component (6, 6'), and the third liner component (7, 7') are coupled to one another such that, when changing the length (L) of the first supporting element (3) and of the at least one second supporting element (3'), a displacement of the second liner component (6, 6') to the first liner component (5, 5') in a direction parallel to the change of length (L) synchronously causes a displacement of the third liner component (7, 7') to the second liner component (6, 6') in the same direction, and a synchronization device configured to synchronize the displacement of the second liner component (6, 6') to the first liner component (5, 5') or the displacement of the third liner component (7, 7') to the second liner component (6, 6') between the first supporting element (3) and the at least one second supporting element (3'), wherein the supporting device comprises a drive or power assist element (17, 17') driving or assisting the change of length (L) of the first supporting element (3) and of the at least one second supporting element (3'), and the drive or power assist element (17, 17') is configured to exert a drive or power assist force between the first liner component (5, 5') and the second liner component (6, 6') and wherein the synchronization device comprises: a first ropelike synchronization element (11) being a plastic band, or a steel rope, at one end, fixed to one of the liner components (5, 6, 7) of the first supporting element (3) and, at the other end, fixed to the same of the liner components (5', 6', 7') of the at least one second supporting element (3'), and two first diverter rollers (12, 13) respectively fixed to another one of the liner components (5, 5', 6, 6', 7, 7') of the first supporting element (3) and of the at least one second supporting element (3, 3'), wherein the other one of the liner components (5, 5', 6, 6', 7, 7') of the first supporting element (3) and of the at least one second supporting element (3') is respectively the same liner component (5, 5', 6, 6', 7, 7'), and a redirection of the first ropelike synchronization element (11) by means of the first diverter rollers (12, 13) takes place in a manner that a first relative displacement (RV) between two of the liner components (5, 6, 7) of the first supporting element (3) results in a synchronous relative displacement (RV) between the two same liner components (5', 6', 7') of the at least one second supporting element (3'), wherein the ropelike synchronization element is fixed to the second liner component.

2. Supporting device according to claim 1, wherein an amount of the displacement between the second liner component (6, 6') and the first liner component (5, 5') and an amount of the displacement between the third liner component (7, 7') and the second liner component (6, 6') are identical.

3. Supporting device according to claim 1, wherein the supporting device comprises:

an endless ropelike element (8) being a plastic band or a steel rope;

two third diverter rollers (9, 10) being arranged in a spaced manner in the direction of the change of length (L) and being connected with the second liner component (6, 6'), wherein the endless ropelike element (8) is configured to be redirected by the two third diverter rollers (9, 10) in a backlash-free manner and a portion (8.1, 8.2) of the endless ropelike element (8) in the direction of the change of length (L) between the two third diverter rollers (9, 10) is respectively connected with the first liner component (5, 5') and the third liner component (7, 7').

4. Supporting device according to claim 1, wherein the synchronization device comprises:

a second ropelike synchronization element (14) being a plastic band, or a steel rope, at one end, fixed to one of the liner components (5, 6, 7) of the first supporting element (3) and, at the other end, fixed to the same of the liner components (5', 6', 7') of the at least one second supporting element (3'); and second diverter rollers (15, 16) respectively fixed to the other one of the liner components (5, 5', 6, 6', 7, 7') of the first supporting element (3) and of the at least one second supporting element (3'), wherein the other one of the liner components (5, 5', 6, 6', 7, 7') of the first supporting element (3) and of the at least one second supporting element (3') is respectively the same liner component (5, 5', 6, 6', 7, 7'); wherein a redirection of the second ropelike synchronization element (14) by means of the second diverter rollers (15, 16) takes place in a manner that an opposite relative displacement (RV') between two of the liner components (5, 6, 7) of the first supporting element (3) opposite to the first relative displacement (RV) in the first supporting element (3) results in a synchronous opposite relative displacement (RV') between the two same liner components (5', 6', 7') of the at least one second supporting element (3').

5. Supporting device according to claim 4, wherein the compression gas spring is provided between the first supporting element (3) and the at least one second supporting element (3') and it is configured to exert a drive or power assist force onto the ropelike synchronization element (11, 14).

6. Supporting device according to claim 1, wherein the drive or power assist element (17, 17') is a compression gas spring.

7. Supporting device according to claim 6, wherein the compression gas spring is arranged in at least one of the first supporting element (3) and the at least one second supporting element (3').

8. Height adjustable table (1) having a supporting device according to claim 1.

* * * * *